United States Patent [19]

Kuzuno et al.

[11] Patent Number: 4,820,181

[45] Date of Patent: Apr. 11, 1989

[54] WATERTIGHT CONNECTOR

[75] Inventors: Katsutoshi Kuzuno; Shigeo Ishizuka; Kazuaki Sakurai; Hiroshi Watanabe, all of Shizuoka, Japan

[73] Assignee: Yazaki Corporation, Tokyo, Japan

[21] Appl. No.: 157,791

[22] Filed: Feb. 19, 1988

[30] Foreign Application Priority Data

Apr. 13, 1987 [JP] Japan ..... 62-54805[U]

[51] Int. Cl.[4] ..... H01R 13/52

[52] U.S. Cl. ..... 439/272; 439/283

[58] Field of Search ..... 439/271–283, 439/586, 587

[56] References Cited

U.S. PATENT DOCUMENTS

| | | | |
|---|---|---|---|
| 3,937,545 | 2/1976 | Cairns et al. | 439/272 |
| 4,486,062 | 12/1984 | Kasugai | 439/271 |
| 4,611,872 | 9/1986 | Ito et al. | 439/277 |
| 4,614,390 | 9/1986 | Baker | 439/275 |
| 4,721,478 | 1/1988 | Sonobe | 439/278 |

FOREIGN PATENT DOCUMENTS

| | | |
|---|---|---|
| 52-127292 | 9/1977 | Japan . |
| 58-186178 | 10/1983 | Japan . |
| 61-54677 | 4/1986 | Japan . |

*Primary Examiner*—David Pirlot

*Attorney, Agent, or Firm*—Robbins & Laramie

[57] ABSTRACT

Disclosed is a watertight connector comprising a male connector housing in which a cavity for containing a packing therein is formed by the combination of an outer wall, an upstanding rear wall extending outwardly from the outer wall and a water-intrusion preventive wall extending forward from the end of the rear wall to surround the corresponding portion of the outer wall, and a mating female connector housing including a hollow columnar portion adapted to be inserted into the cavity to compress the packing thereby completing a watertight joint. In the connector, the packing is formed with an engaging projection extending from its end surface opposed by the rear wall of the male connector housing, and the rear wall is formed with a mating aperture to be engaged watertight by the engaging projection of the packing.

1 Claim, 4 Drawing Sheets

WATERTIGHT CONNECTOR

BACKGROUND OF THE INVENTION

1. Field of the Invention

This invention relates to a watertight connector having means for preventing intrusion of water into the joint between a male connector housing and a female connector housing which are mated with each other to complete a circuit.

2. Description of the Prior Art

A connector including a male connector housing and a female connector housing mated with each other is used to established an electrical connection by mating terminal members built in them, and, in an environment where there is a possibility of exposure to rainwater or the like a watertight connector is used so as to avoid short-circuit trouble.

Such watertight connectors are disclosed in, for example, JP-A No. 58-186178, JUM-A No. 52-127292 and JUM-A No. 61-54677.

In a watertight connector disclosed in, for example, JP-A No. 58-186178 cited above, its male connector housing is formed, at the outside of its outer wall, a water-intrusion preventive wall which surrounds the outer wall in a relation spaced from the outer wall by a predetermined distance, that is, while defining a cavity therebetween. An elastic packing is fixedly mounted in this cavity.

On the other hand, a female connector housing of the connector has a hollow columnar portion which, when the female connector housing is mated with the male connector housing, is inserted into the cavity of the male connector housing to compress the elastic packing thereby sealing the joint watertight.

However, the watertight connector having such a structure is defective in that the packing cannot be easily forced into and fixed in position in the cavity of the male connector housing, and the necessity for extension of the packing arises frequently.

In watertight connectors disclosed in JUM-A No. 52-127292 and JUM No. 61-54677 cited above too, difficulty is also encountered for inserting an elastic packing into a male connector housing. Because of the above difficulty, it is very difficult to confirm as to whether or not the packing has been accurately inserted in a predetermined position in the male connector housing. Therefore, the disclosed watertight connectors are defective in that water tends to leak through the joint when the packing is not accurately inserted in the predetermined position.

SUMMARY OF THE INVENTION

It is an object of the present invention to provide a watertight connector in which a packing can be easily accurately inserted and fixed in a predetermined position, and the fixed position of the packing can also be easily confirmed.

In accordance with the present invention which attains the above object, there is provided a watertight connector comprising a male connector housing and a mating female connector housing, one of the connector housings including an outer wall, an upstanding rear wall extending outwardly along the periphery of the outer wall, and a water-intrusion preventive wall extending forward from the outer end of the rear wall in parallel to the outer wall to surround the corresponding portion of the outer wall, the outer wall, the rear wall and the water-intrusion preventive wall defining a cavity for containing a packing therein, and the other connector housing including a hollow columnar portion adapted to be inserted into the cavity to compress the packing thereby completing a watertight joint, wherein the packing is formed with an engaging projection extending from the end surface thereof opposed by the rear wall of the former connector housing, and the rear wall is formed with a mating aperture to be engaged watertight by the engaging projection of the packing.

DETAILED DESCRIPTION OF THE INVENTION

Figure 3A:
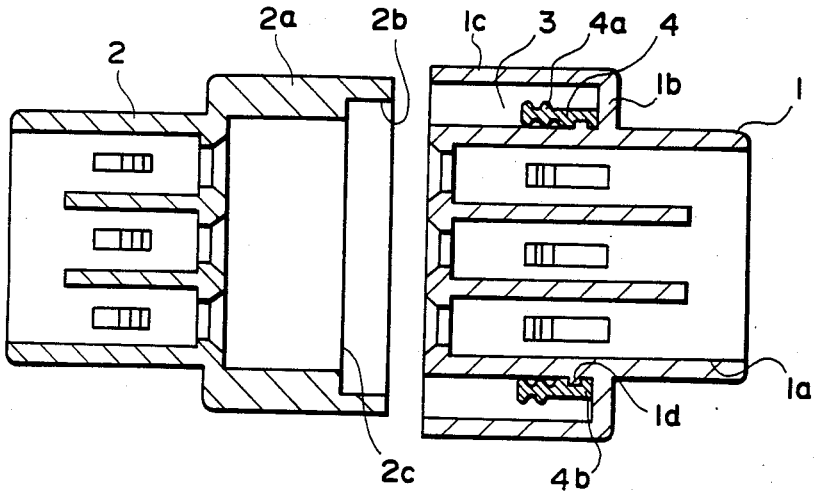
Fig. 3A PRIOR ART
FIG. 3A is a sectional view of a male connector housing and a mating female connector housing of a prior art watertight connector.

FIG. 3A is a sectional view of a male connector housing 1 and a mating female connector housing 2 of a prior art watertight connector disclosed in JP-A No. 58-186178. The male and female connector housings 1 and 2 have built-in female terminal members and male terminal members (not shown) respectively which are engaged and fixed in position to establish an electrical connection. The male connector housing 1 includes an outer wall 1*a*, an upstanding rear wall 1*b* extending outwardly along the periphery of the outer wall 1*a*, and a water-intrusion preventive wall 1*c* extending forward from the outer end of the rear wall 1*b* in parallel to the outer wall 1*a* to surround the corresponding portion of the outer wall 1*a*. These walls 1*a*, 1*b* and 1*c* define a cavity 3 therebetween.

A ring-shaped packing 4 is received in the cavity 3 to prevent intrusion of water into the joint between the male and female connector housings 1 and 2. This packing 4 has an elasticity, and a plurality of protruding ribs 4*a* are formed on the inner and outer peripheral surfaces of the packing 4 so as to improve the sealing effect.

Figure 3B:
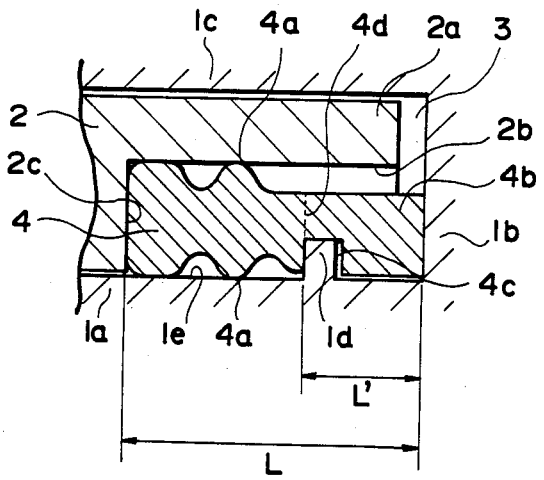
Fig. 3B PRIOR ART
FIG. 3B is an enlarged perspective view of part of the male and female connector housings shown in FIG. 3A when mated with each other.

FIG. 3B is an enlarged sectional view of the joint between the male and female connector housings 1 and 2. The packing 4 is formed with a projection 4*b* extending from its rear end 4*d*, and a peripheral groove 4*c* is cut in the base portion of the projection 4*b*. The outer wall 1*a* of the male connector housing 1 is formed with a peripheral rib 1*d* engageable with the groove 4*c* so as to fix the packing 4 in a predetermined position in the cavity 3.

On the other hand, the female connector housing 2 has a hollow columnar portion 2*a* that can be inserted into the cavity 3. The hollow columnar portion 2*a* has two surfaces 2*b* and 2*c* for making pressure engagement with the front end of the packing 4. When the male and female connector housings 1 and 2 are mated with each other, the packing 4 compressed by the engaging surfaces 2*b* and 2*c* of the hollow columnar portion 2*a* is pressed against the outer peripheral surface 1*e* of the outer wall 1*a* and the rear wall 1*b* of the male connector housing 1, thereby sealing the joint watertight and preventing intrusion of water into the joint.

However, in the prior art watertight connector having such a structure, the packing 4 must be forced into the cavity 3 while overriding the rib 1*d* in order to fix the packing 4 in the cavity 3, and difficulty is encountered for forcing the packing 4 into the cavity 3 and fixing it in the predetermined position. Further, because of the provision of the projection 4*b* extending from the rear end 4*d* of the packing 4, the total length L of the packing 4 requires an extra portion having a length L' ranging from the rear end 4*d* of its body engaging the rib 1*d* to the rear end of the extension 4*b*, engaging the wall 1*b*. Therefore, the prior art watertight connector is defective in that the size of the male connector housing 1 must be increased by an amount corresponding to the extra length L'.

Figure 4:
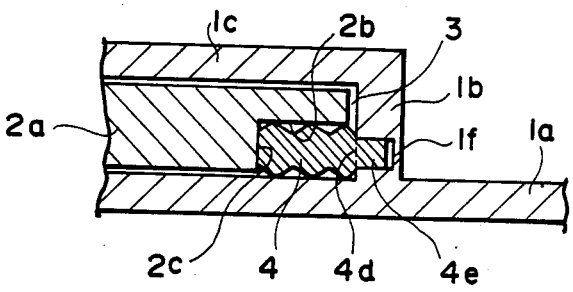
Fig. 4 PRIOR ART
FIG. 4 is an enlarged sectional view of part of a male connector housing and a mating female connector housing of another prior art watertight connector when mated with each other.

FIG. 4 is an enlarged sectional view of the joint between a male connector housing and a mating female connector housing of another prior art watertight connector disclosed in JUM-A No. 52-127292 and JUM-A No. 61-54677. Referring to FIG. 4 in which like reference numerals are used to designate like parts appearing in FIG. 3B, projections 4*e* project from the rear end 4*d* of a ring-shaped packing 4, and corresponding engaging recesses 1*f*are formed in an upstanding rear wall 1*b* extending from an outer wall 1*a* of the male connector housing. The projections 4*e* of the packing 4 are fitted in the respective engaging recesses 1*f* to fix the packing 4 in a cavity 3.

In this prior art watertight connector, the projections 4*e* of the packing 4 fitted in the engaging recesses 1*f* are compressed to fix the packing 4 in the cavity 3, and, for this purpose, the diameter of the projections 4*e* must be larger than that of the engaging recesses 1*f*. Therefore, the projections 4*e* cannot be easily fitted in the engaging recesses 1*f*, and it is very difficult to confirm as to whether or not the projections 4*e* could be accurately fitted in the engaging recesses 1*f*. Thus, when the projections 4*e* are not accurately fitted in the engaging recesses 1*f*, there is possibility of leakage of water through the joint.

Figure 1A:
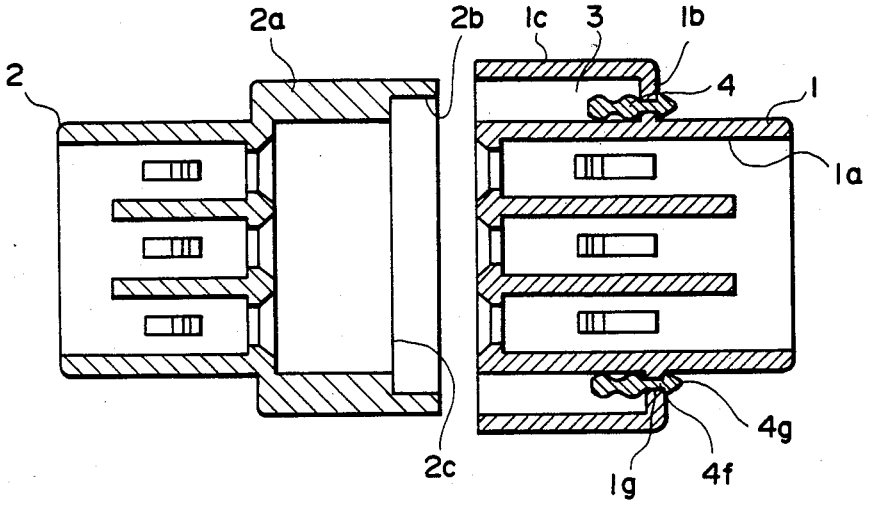
FIG. 1A is a sectional view of a male connector housing and a mating female connector housing constituting an embodiment of the watertight connector according to the present invention.
Figure 1B:
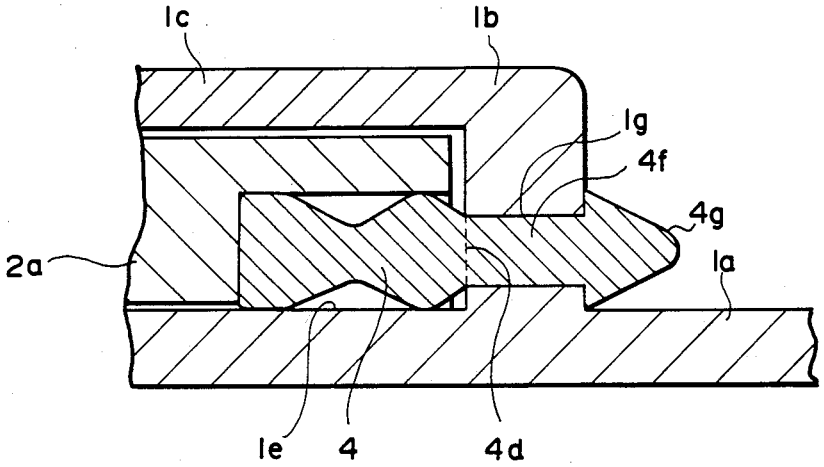
FIG. 1B is an enlarged sectional view of part of the male and female connector housings shown in FIG. 1A when mated with each other.

A preferred embodiment of the watertight connector according to the present invention will now be described with reference to FIGS. 1A and 1B. In FIGS. 1A and 1B, like reference numerals are used to designate like appearing in FIGS. 3A and 3B.

Referring to FIG. 1A, a male connector housing 1 and a mating female connector housing 2 constitute the watertight connector embodying the present invention. Female terminal members and watertight plugs (not shown) are built in the male connector housing 1, and similarly male terminal members and watertight plugs (not shown) are built in the female connector housing 2. These terminal members are engaged and fixed in position to establish an electrical connection.

The male connector housing 1 includes an outer wall 1*a*, an upstanding rear wall 1*b* extending outwardly along the periphery of the outer wall 1*a*, and a water-intrusion preventive wall 1*c* extending forward from the outer end of the rear wall 1*b* in parallel to the outer wall 1*a* to surround the corresponding portion of the outer wall 1*a*. The outer wall 1*a*, the rear wall 1*b* and the water-intrusion preventive wall 1*c* define a cavity 3 therebetween. A female connector housing 2 mating with the m le connector housing 1 is provided with a hollow columnar portion 2*a* adapted to be inserted into the cavity 3.

Figure 2A:
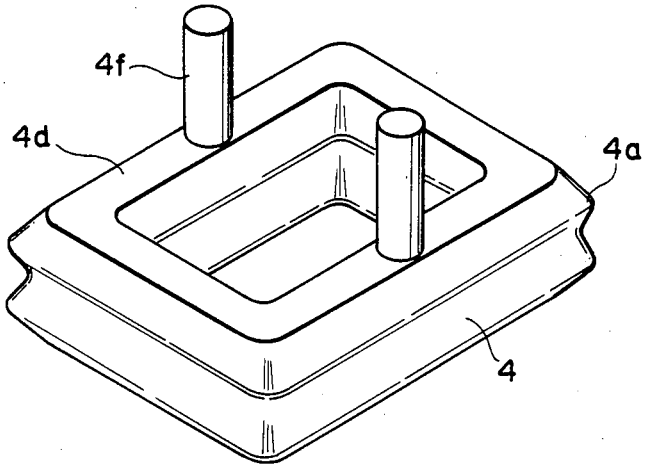
FIG. 2A is an enlarged perspective view of a ring-shaped packing preferably employed in the embodiment shown in FIG. 1A.

A ring-shaped elastic packing 4 is fixedly disposed in the cavity 3. The feature of this packing 4 will be described in detail with reference to FIG. 2A which is an enlarged perspective view of the packing 4. Referring to FIG. 2A, the packing 4 includes a plurality of or, for example, a pair of engaging projections 4*f* projecting from its end surface 4*d*. As shown in FIGS. 1A and 1B, a pair of slots or apertures 1*g* are bored in the rear wall 1*b* of the male connector housing 1, and the engaging projections 4*f* of the packing 4 are fitted in these apertures 1*g* respectively. The length of the engaging projections 4*f* is selected to be larger than that of the apertures 1*g* so that the projections 4*f* are partly exposed from the other side of the rear wall 1*b*. Then, when the exposed portions of the projections 4*f* are deformed under heat by an iron or the like to form expanded engaging heads 4*g*, the packing 4 is tightly fixed in the cavity 3. Completion of a watertight joint by compression of the packing 4 is as described already with reference to FIGS. 3A, 3B and 4 showing the prior art connectors.

Figure 2B:
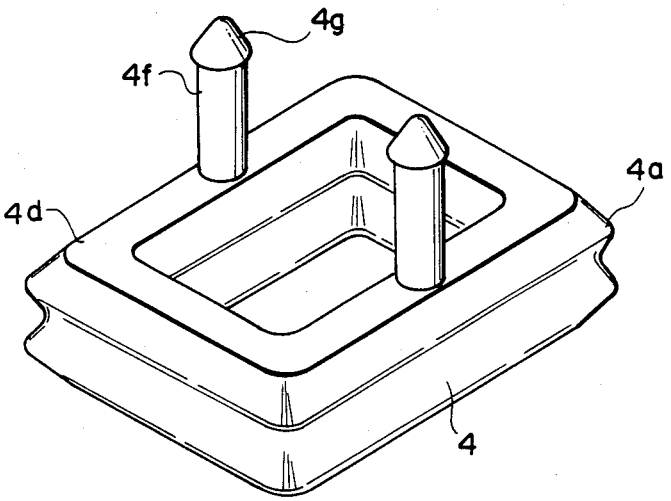
FIG. 2B is an enlarged perspective view of the packing in which an expanded head portion previously formed as an integral part of each of the engaging projections shown in FIG. 2A.

FIG. 2B shows a modification of the packing 4 shown in FIG. 2A. FIG. 2B illustrates that the expanded engaging heads 4*g* are previously integrally formed in the step of molding the packing 4. Such a modification obviates the necessity for later deformation under heat by means of, for example, an iron, thereby improving the efficiency of assembling.

It will be understood from the foregoing description of the present invention that the packing can be easily fixed in the predetermined position in the cavity by merely fitting the engaging projections of the packing in the apertures bored in the rear wall of the male connector housing. Also, whether or not the packing is fixed in the predetermined position in the cavity can be easily confirmed by visually observing the protrusion of the heads of the engaging projections from the apertures.

What is claimed is:

1. A watertight connector comprising a male connector housing and a mating female connector housing, a first one of said connector housings including an outer wall, an upstanding rear wall extending outwardly along the periphery of said outer wall, a water-intrusion preventive wall extending forward from the outer end of said rear wall in parallel to said outer wall to surround the corresponding portion of said outer wall, and a packing, said outer wall, said rear wall and said water-intrusion preventive wall defining a cavity for containing said packing therein, and the other connector housing including a hollow columnar portion adapted to be inserted into said cavity to compress said packing thereby completing a watertight joint, wherein said packing is formed with an end surface opposed by the rear wall of said first connector housing and an engaging projection extending from said end surface, and said rear wall is formed with a mating aperture to be engaged in a watertight manner by said engaging projection of said packing, said engaging projection having a leading end portion which is partly exposed from said aperture after said engaging projection is fitted into said aperture, said exposed portion of said engaging projection being deformed into an expanded engaging head.

* * * * *